US011480399B2

(12) United States Patent
Salters et al.

(10) Patent No.: US 11,480,399 B2
(45) **Date of Patent: *Oct. 25, 2022**

(54) COOLING APPARATUS FOR COOLING A FLUID BY MEANS OF SURFACE WATER

(71) Applicant: KONINKLIJKE PHILIPS N.V., Eindhoven (NL)

(72) Inventors: Bart Andre Salters, Eindhoven (NL); Roelant Boudewijn Hietbrink, Utrecht (NL)

(73) Assignee: Koninklijke Philips N.V., Eindhoven (NL)

( * ) Notice: Subject to any disclaimer, the term of this patent is extended or adjusted under 35 U.S.C. 154(b) by 10 days.

This patent is subject to a terminal disclaimer.

(21) Appl. No.: 17/158,047

(22) Filed: Jan. 26, 2021

(65) Prior Publication Data

US 2021/0148658 A1 May 20, 2021

Related U.S. Application Data

(60) Continuation of application No. 16/196,725, filed on Nov. 20, 2018, now Pat. No. 10,928,143, which is a (Continued)

(30) Foreign Application Priority Data

Dec. 12, 2014 (EP) ..... 14197744
Jul. 21, 2015 (EP) ..... 15177631

(51) Int. Cl.
*F28F 3/00* (2006.01)
*F28F 19/00* (2006.01)
(Continued)

(52) U.S. Cl.
CPC ..... *F28F 19/00* (2013.01); *B08B 7/0057* (2013.01); *B08B 9/023* (2013.01); *B08B 17/02* (2013.01);
(Continued)

(58) Field of Classification Search
CPC .. F28F 19/00; F28F 1/325; F28F 19/04; F28F 2265/20; F28D 1/022; F28D 1/0475;
(Continued)

(56) References Cited

U.S. PATENT DOCUMENTS 4,320,085 A 3/1982 Takeguchi
4,778,653 A 10/1988 Kamimura et al.
(Continued)

FOREIGN PATENT DOCUMENTS

DE 102008006464 A1 1/2009
DE 102008029464 A1 1/2010
(Continued)

OTHER PUBLICATIONS

Müller-Steinhagen, H., "Heat Exchanger Fouling: Mitigation and Cleaning Technologies", pp. 220-221, Sep. 2000.

*Primary Examiner* — Davis D Hwu

(57) ABSTRACT

A cooling apparatus (1) for cooling a fluid withsurface water, comprising at least one tube (8) for containing and transporting the fluid in its interior, the exterior of the tube (8) being in operation at least partially submerged in the surface water so as to cool the tube (8) to thereby also cool the fluid. The cooling apparatus (1) further comprises at least one light source (9) for producing light that hinders fouling on the submerged exterior, wherein the light source (9) is dimensioned and positioned with respect to the tube (8) so as to cast anti-fouling light over the tube's exterior. By this structure anti-fouling of the cooling apparatus (1) can be assured in an alternative and effective manner.

20 Claims, 7 Drawing Sheets

Related U.S. Application Data division of application No. 15/534,770, filed as application No. PCT/EP2015/078612 on Dec. 4, 2015, now Pat. No. 10,228,199.

(51) Int. Cl.

| | |
|---|---|
| ***B08B 9/023*** | (2006.01) |
| ***B08B 17/02*** | (2006.01) |
| ***B08B 7/00*** | (2006.01) |
| ***F28F 19/04*** | (2006.01) |
| ***F28D 1/047*** | (2006.01) |
| ***F28D 1/02*** | (2006.01) |
| ***B63J 2/12*** | (2006.01) |
| ***F28F 1/32*** | (2006.01) |
| *F01P 3/20* | (2006.01) |
| *F01P 11/06* | (2006.01) |
| *F28D 21/00* | (2006.01) |

(52) U.S. Cl.

CPC ..... *B63J 2/12* (2013.01); *F28D 1/022* (2013.01); *F28D 1/0475* (2013.01); *F28F 1/325* (2013.01); *F28F 19/04* (2013.01); *F01P 3/207* (2013.01); *F01P 2011/063* (2013.01); *F28D 2021/0092* (2013.01); *F28F 2265/20* (2013.01)

(58) Field of Classification Search

CPC ..... F28D 2021/0092; B08B 7/0057; B08B 9/023; B63J 12/12; F01P 3/207; F01P 2011/063

USPC ..... 165/41

See application file for complete search history.

(56) References Cited

U.S. PATENT DOCUMENTS

| | | | |
|---|---|---|---|
| 5,308,505 | A | 5/1994 | Titus et al. |
| 7,077,190 | B2 | 7/2006 | Hayashi |
| 10,928,143 | B2 * | 2/2021 | Salters ..... F28D 1/0475 |
| 2006/0266042 | A1 | 11/2006 | Levine |
| 2013/0048877 | A1 | 2/2013 | Thoren |
| 2013/0098590 | A1 | 4/2013 | Nitta et al. |
| 2014/0196745 | A1 | 7/2014 | Whelan et al. |
| 2017/0343287 | A1 | 11/2017 | Salters |
| 2017/0343305 | A1 | 11/2017 | Salters |
| 2017/0350653 | A1 | 12/2017 | Salters |

FOREIGN PATENT DOCUMENTS

| | | | |
|---|---|---|---|
| DE | 102010052446 | A1 | 2/2012 |
| EP | 2127518 | A1 | 12/2009 |
| EP | 2485003 | A1 | 8/2012 |
| JP | 61130843 | A | 6/1986 |
| JP | 5023502 | A | 2/1993 |
| JP | 1019489 | A | 1/1998 |
| JP | 2003240107 | A | 8/2003 |
| WO | 0078605 | A1 | 12/2000 |
| WO | 2001025086 | A1 | 4/2001 |
| WO | 2011078771 | A1 | 6/2011 |
| WO | 2014046142 | A1 | 3/2014 |

* cited by examiner

COOLING APPARATUS FOR COOLING A FLUID BY MEANS OF SURFACE WATER

CROSS REFERENCE TO RELATED APPLICATIONS

This application is a continuation of U.S. application Ser. No. 16/196,725 filed Nov. 20, 2018 which is a divisional application of U.S. application Ser. No. 15,534770 filed Jun. 9, 2017 which is the US National Stage Application of PCT/EP2015/078612 filed Dec. 4, 2015 which claims priority to EP Application No. 14197744.7 filed Dec. 12, 2014 and EP Application No. 15177631.7 filed Jul. 21, 2015.

FIELD OF THE INVENTION

The present disclosure relates to a cooling apparatus which is adapted for the prevention of fouling, commonly referred to as anti-fouling. The disclosure specifically relates to anti-fouling of sea box coolers.

BACKGROUND OF THE INVENTION

Bio-fouling or biological fouling is the accumulation of microorganisms, plants, algae, and/or animals on surfaces. The variety among bio-fouling organisms is highly diverse and extends far beyond attachment of barnacles and seaweeds. According to some estimates, over 1800 species comprising over 4000 organisms are responsible for bio-fouling. Bio-fouling is divided into microfouling which includes biofilm formation and bacterial adhesion, and macrofouling which is the attachment of larger organisms. Due to the distinct chemistry and biology that determine what prevents them from settling, organisms are also classified as hard or soft fouling types. Calcareous (hard) fouling organisms include barnacles, encrusting bryozoans, mollusks, polychaete and other tube worms, and zebra mussels. Examples of non-calcareous (soft) fouling organisms are seaweed, hydroids, algae and biofilm "slime". Together, these organisms form a fouling community.

In several circumstances bio-fouling creates substantial problems. Machinery stops working, water inlets get clogged, and heat exchangers suffer from reduced performance. Hence the topic of anti-fouling, i.e. the process of removing or preventing bio-fouling from forming, is well known. In industrial processes, bio-dispersants can be used to control bio-fouling. In less controlled environments, organisms are killed or repelled with coatings using biocides, thermal treatments or pulses of energy. Nontoxic mechanical strategies that prevent organisms from attaching include choosing a material or coating with a slippery surface, or creation of nanoscale surface topologies similar to the skin of sharks and dolphins which only offer poor anchor points.

Antifouling arrangements for cooling units that cool the engine fluid of a ship via seawater are known in the art. DE102008029464 relates to a sea box cooler comprising an antifouling system by means of regularly repeatable overheating. Hot water is separately supplied to the heat exchanger tubes so as to minimize the fouling propagation on the tubes.

SUMMARY OF THE INVENTION

Bio-fouling of box coolers causes severe problems. The main issue is a reduced capacity for heat transfer as the thick layers of bio-fouling are effective heat insulators. As a result, the ship engines have to run at a much lower speed, slowing down the ship itself, or even come to a complete halt, due to over-heating.

There are numerous organisms that contribute to bio-fouling. This includes very small organisms like bacteria and algae, but also very large ones such as crustaceans. The environment, temperature of the water, and purpose of the system all play a role here. The environment of a box cooler is ideally suited for bio-fouling: the fluid to be cooled heats up to a medium temperature and the constant flow of water brings in nutrients and new organisms.

Accordingly methods and apparatus are necessary for anti-fouling. Prior art systems, however, may be inefficient in their use, require regular maintenance and in most cases result in ion discharge to the sea water with possible hazardous effects.

Hence, it is an aspect of the invention to provide a cooling apparatus for the cooling of a ship's machinery with an alternative anti-fouling system according to the appended independent claims. The dependent claims define advantageous embodiments.

Herewith an approach is presented based on optical methods, in particular using ultra-violet light (UV). It appears that most micro-organisms are killed, rendered inactive or unable to reproduce with 'sufficient' UV light. This effect is mainly governed by the total dose of UV light. A typical dose to kill 90% of a certain micro-organism is 10 mW-hours per square meter.

The cooling apparatus for the cooling of a ship's machinery is suitable to be placed in a box that is defined by the hull of the ship and partition plates. Entry and exit openings are provided on the hull so that sea water can freely enter the box volume, flow over the cooling apparatus and exit via natural flow and/or under the influence of motion of the ship. The cooling apparatus comprises a bundle of tubes through which a fluid to be cooled can be conducted and at least one light source for generating an anti-fouling light, arranged by the tubes so as to emit anti-fouling light over the tubes' exterior surface.

In an embodiment of the cooling apparatus the anti-fouling light emitted by the light source is in the UV or blue wavelength range from about 220 nm to about 420 nm, preferably about 260 nm. Suitable anti-fouling levels are reached by UV or blue light from about 220 nm to about 420 nm, in particular at wavelengths shorter than about 300 nm, e.g. from about 240 nm to about 280 nm which corresponds to what is known as UV-C. Anti-fouling light intensity in the range of 5-10 $mW/m^2$ (milliwatts per square meter) can be used. Obviously higher doses of antifouling light would also achieve the same if not better results.

The light source may be a lamp having a tubular structure in an embodiment of the cooling apparatus. For these light sources as they are rather big the light from a single source is generated over a large area. Accordingly it is possible to achieve the desired level of anti-fouling with a limited number of light sources which render the solution rather cost effective.

A very efficient source for generating UVC is the low-pressure mercury discharge lamp, where on average 35% of input watts is converted to UVC watts. The radiation is generated almost exclusively at 254 nm viz. at 85% of the maximum germicidal effect. Low pressure tubular flourescent ultraviolet (TUV) lamps are known which have an envelope of special glass that filters out ozone-forming radiation.

For various germicidal TUV lamps the electrical and mechanical properties are identical to their lighting equivalents for visible light. This allows them to be operated in the same way i.e. using an electronic or magnetic ballast/starter circuit. As with all low pressure lamps, there is a relationship between lamp operating temperature and output. For example, in low pressure lamps the resonance line at 254 nm is strongest at a certain mercury vapour pressure in the discharge tube. This pressure is determined by the operating temperature and optimises at a tube wall temperature of 40° C., corresponding with an ambient temperature of about 25° C. It should also be recognised that lamp output is affected by air currents (forced or natural) across the lamp, the so called chill factor. The reader should note that, for some lamps, increasing the air flow and/or decreasing the temperature can increase the germicidal output. This is met in high output (HO) lamps viz. lamps with higher wattage than normal for their linear dimension.

A second type of UV source is the medium pressure mercury lamp, here the higher pressure excites more energy levels producing more spectral lines and a continuum (recombined radiation). It should be noted that the quartz envelope transmits below 240 nm so ozone can be formed from air. Advantages of medium pressure sources are:

high power density;

high power, resulting in fewer lamps than low pressure types being used in the same application; and less sensitivity to environment temperature.

Further, Dielectric Barrier Discharge (DBD) lamps can be used. These lamps can provide very powerful UV light at various wavelengths and at high electrical-to-optical power efficiencies.

The germicidal doses needed can also easily be achieved with existing low cost, lower power UV LEDs. LEDs can generally be included in relatively smaller packages and consume less power than other types of light sources. LEDs can be manufactured to emit (UV) light of various desired wavelengths and their operating parameters, most notably the output power, can be controlled to a high degree.

In a particular embodiment of the cooling apparatus, the light sources are arranged substantially perpendicular to the orientation of the tubes. Accordingly it is provided that the anti-fouling light generated by the lamp to be scattered over various pipes. Hence the risk of a single pipe which is closer to the light source receiving and absorbing a big percentage of the light and the other pipes remaining in the shade of this first pipe is avoided.

In a further particular embodiment of the cooling apparatus, the light sources are arranged in parallel to each other. Thus similar distribution of light over the entire cooling apparatus is achieved and any missed spots on the pipes are avoided and thus the anti-fouling efficiency is increased.

In a further particular embodiment of the cooling apparatus the light source extends along the full width of the cooling apparatus. Thus the scattering of the emitted anti-fouling light to all the pipes are assured.

In an embodiment of the present invention the cooling apparatus comprises a bundle of tubes wherein the tubes are U-shaped and at least one light source is arranged at the inner side center of the semicircular tube portion.

In an embodiment of the present invention at least one light source is arranged to emit light towards the inner side of the tube bundle and at least one light source is arranged to emit light towards the outer side of the tube bundle. This configuration facilitates anti-fouling of both on the inner and the outer sides of the tubes.

In a further embodiment of the present invention the tube bundle comprises tube layers arranged in parallel along its width such that each tube layer comprises a plurality of hairpin type tubes having two straight tube portions and one semicircular portion so as to form a U-shaped tube and wherein the tubes are disposed with U-shaped tube portions concentrically arranged and straight tube portions arranged in parallel, so that the innermost U-shaped tube portions are of relatively small radius and the outermost U-shaped tube portions are of relatively large radius, with the remaining intermediate U-shaped tube portions are of progressively graduated radius of curvature disposed therebetween.

In a further aspect of the embodiment described above at least one light source is arranged at the inner side center of the innermost semicircular tube portion. Accordingly anti-fouling light is more efficiently scattered on the inner side of the rounding bottom of the U.

In an embodiment of the present invention the tube bundle conforms to a rectangular prism shape with a half cylinder shape connected to the rectangular prism portion at the bottom end and at least one of the light sources is arranged to lie on or in parallel to the axis line of the said cylinder.

In an embodiment of the present invention the tube bundle conforms with an elongated cylindrical shape with a hemispherical shape connected to the cylindrical portion at the bottom end and at least one of the light sources is arranged to lie on or in parallel to the axis line of the said cylinder.

In an embodiment of the present invention at least one light source is arranged in-between each tube. In an embodiment the cooling apparatus comprises a plurality of transverse lamellas on the tube bundle disposed in longitudinally spaced relation with each other and having the straight tube portions extending therethrough, thereby to maintain the tubes in fixed spaced relationship with each other throughout their lengths. Also, assuming that the lamellas are in contact with the tubes, the lamellas may contribute to heat transfer from the tubes so that a similar amount of heat transfer can be achieved with fewer tubes and thus the amount of shadow cast by tubes among other tubes is minimized thereby increasing the antifouling efficiency. The lamellas may be of any suitable shape and may be shaped like plates, for example. It is furthermore possible for the lamellas to be provided with two types of apertures, namely one type of aperture for allowing the tubes to pass through and another type of aperture for realizing that a flow of cooling medium such as water along the tubes is hindered only to a minimum extent by the presence of the lamellas. According to another option, the lamellas may be hollow so as to be capable of communicating with the tubes and transporting the fluid to be cooled in order to achieve an even larger contribution of the lamellas to the heat transfer. According to yet another option, each of the lamellas may be formed as an integral whole with a number of sections of tube portions extending through the lamellas. This option may be advantageous in view of the manufacturing process of the cooling apparatus, as according to this option, putting the lamellas in place with respect to the tubes requires nothing more than stacking the lamellas and interconnecting the sections of the tube portions.

In an embodiment the cooling apparatus comprises a plurality of longitudinal lamellas on the tube bundle extending in between two tube portions or between a tube portion and a light source. Accordingly similar to the embodiment above enhanced heat transfer and antifouling properties are achieved.

In further variation of the above embodiment the light source is positioned at the center, the tubes are positioned in a cylindrical configuration around the light source and the lamellas are extending from each straight tube portion towards the central light source. In this embodiment the cooling apparatus is actually a circular style heat exchanger and the light source is arranged in center of the heat exchanger such that it would lie in parallel with the straight tube portions.

In an embodiment of the cooling apparatus the light sources are arranged such that there exists at least one light source in between each tube. Accordingly the risk of the tubes casting a shade over each other is mitigated and a desired level of anti-fouling is achieved.

In an embodiment of the cooling apparatus the tubes and/or the lamellas are at least partially coated with a light reflective coating. Advantageously, the light reflective coating is adapted to cause the antifouling light to reflect in a diffuse way so that light is distributed more effectively over the tubes.

In an embodiment of the cooling apparatus the light source is placed in a sleeve to protect the light source from outside effects.

In an embodiment of the cooling apparatus the cooling apparatus comprises a tube plate on which the tubes are mounted, and connected to the tube plate a fluid header comprising one inlet stub and one outlet stub for the entry and the exit of the fluid to and from the tubes respectively. In a version of this embodiment one end of the sleeve is attached to the fluid header. Accordingly when installed in a final usage location the light source will be accessible from the outside as well as the inlet stub and the outlet stub, without a need for demounting the cooling apparatus from the installed position.

In an embodiment of the cooling apparatus the cooling apparatus is arranged for avoiding shadows over substantially the entire submerged portion of the exterior of the tube, so that this portion is protected from fouling.

In a version of the above-mentioned embodiment the shadows are avoided by positioning the light source with respect to the tubes. The shadows may be avoided by positioning the light source substantially perpendicular to the orientation of the tubes and/or when the tubes are U-shaped by the light source being arranged at the inner side center of the rounding bottom of the tubes. Alternatively shadows may also be avoided by decreasing damping of the light, for example by increasing reflection of the light.

The invention furthermore relates to a cooling apparatus as mentioned in the foregoing, in a situation prior to installation of the at least one light source, i.e. a cooling apparatus comprising a bundle of tubes for containing and transporting fluid in their interior, the exterior of the tubes being in operation at least partially submerged in water so as to cool the tube to thereby also cool the fluid, a tube plate on which the tubes are mounted and to which the tubes are connected, a fluid header comprising an inlet stub and an outlet stub for the entry and the exit of the fluid to and from the tubes respectively, the apparatus being adapted to receive at least one light source for producing light that hinders fouling by casting anti-fouling light over the tubes' exterior, preferably the adaptation comprising a sleeve for accommodating the light source, the sleeve being attached to the fluid header so as to allow the light source to be arranged therein to be accessible from the outside.

The invention also provides a ship comprising a cooling apparatus as described above. In such an embodiment the inner surfaces of the box in which the cooling apparatus is placed may be at least partially coated with a light reflective coating. Similarly to the embodiment above as a result of this particular embodiment the anti-fouling light can be made to reflect in a diffuse way so that light is distributed more effectively over the tubes. Furthermore in such an embodiment the light source may be associated with an inner surface of the box in any suitable manner, particularly be part of or connected to or attached to the inner surface of the box.

The term "substantially" herein, such as in "substantially parallel" or in "substantially perpendicular", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "comprising" may in an embodiment refer to "consisting of" but may in another embodiment also refer to "containing at least the defined species and optionally one or more other species".

It is to be understood that the terms so used are interchangeable under appropriate circumstances and that the embodiments of the invention described herein are capable of operation in other sequences than described or illustrated herein.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The article "a" or "an" preceding an element does not exclude the presence of a plurality of such elements. The mere fact that certain measures are recited in mutually different dependent claims does not indicate that a combination of these measures cannot be used to advantage.

The invention further applies to a device comprising one or more of the characterizing features described in the description and/or shown in the attached drawings.

The various aspects discussed in this patent can be combined in order to provide additional advantages. Furthermore, some of the features can form the basis for one or more divisional applications.

BRIEF DESCRIPTION OF THE DRAWINGS

Embodiments of the invention will now be described, by way of example only, with reference to the accompanying schematic drawings in which corresponding reference symbols indicate corresponding parts, and in which.

Figure 1:
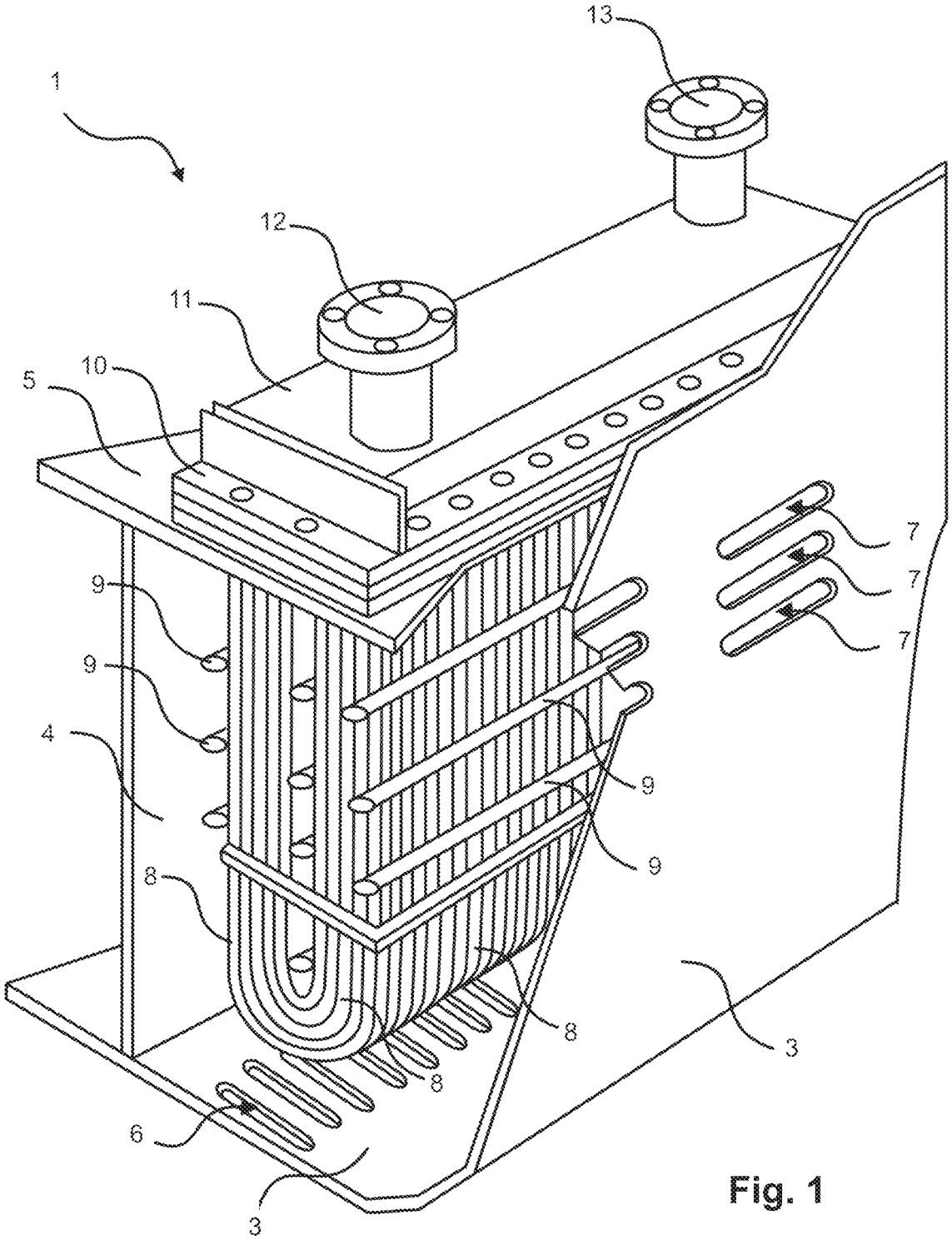
FIG. 1 is a schematic representation of an embodiment of the cooling apparatus.

The drawings are not necessarily on scale.

DETAILED DESCRIPTION OF EMBODIMENTS

While the disclosure has been illustrated and described in detail in the drawings and foregoing description, such illustration and description are to be considered illustrative or exemplary and not restrictive; the disclosure is not limited to the disclosed embodiments. It is further noted that the drawings are schematic, not necessarily to scale and that details that are not required for understanding the present invention may have been omitted. The terms "inner", "outer", "along", "longitudinal", "bottom" and the like relate to the embodiments as oriented in the drawings, unless otherwise specified. Further, elements that are at least substantially identical or that perform an at least substantially identical function are denoted by the same numeral.

FIG. 1 shows as a basic embodiment, a schematic view of a cooling apparatus 1 for the cooling of a ship's engine, placed in a box defined by the hull 3 of the ship and partition plates 4, 5 such that entry and exit openings 6, 7 are provided on the hull 3 so that sea water can freely enter the box volume, flow over the cooling apparatus 1 and exit via natural flow, comprising a bundle of tubes 8 through which a fluid to be cooled can be conducted, at least one light source 9 for generating an anti-fouling light, arranged by the tubes 8 so as to emit the anti-fouling light on the tubes 8. Hot fluid enters the tubes 8 from above and conducted all the way and exits once again, now cooled from the top side. Meanwhile sea water enters the box from the entry openings 6, flows over the tubes 8 and receives heat from the tubes 8 and thus the fluid conducted within. Taking the heat from the tubes 8 sea water warms up and rises. The sea water then exits the box from the exit openings 7 which are located at a higher point on the hull 3. During this cooling process any bio organisms existing in the sea water tend to attach to the tubes 8 which are warm and provide a suitable environment for the organisms to live in, the phenomena known as fouling. To avoid such attachment at least one light source 9 is arranged by the tubes 8. The light source 9 emits the anti-fouling light on the outer surface of the tubes 8. Accordingly fouling formation is avoided. As illustrated in FIG. 1 one or more tubular lamps can be used as a light source 9 to realize the aim of the invention.

As shown in FIG. 1 in an embodiment of the invention the light sources 9 are arranged substantially perpendicular to the orientation of the tubes 8.

Figure 3:
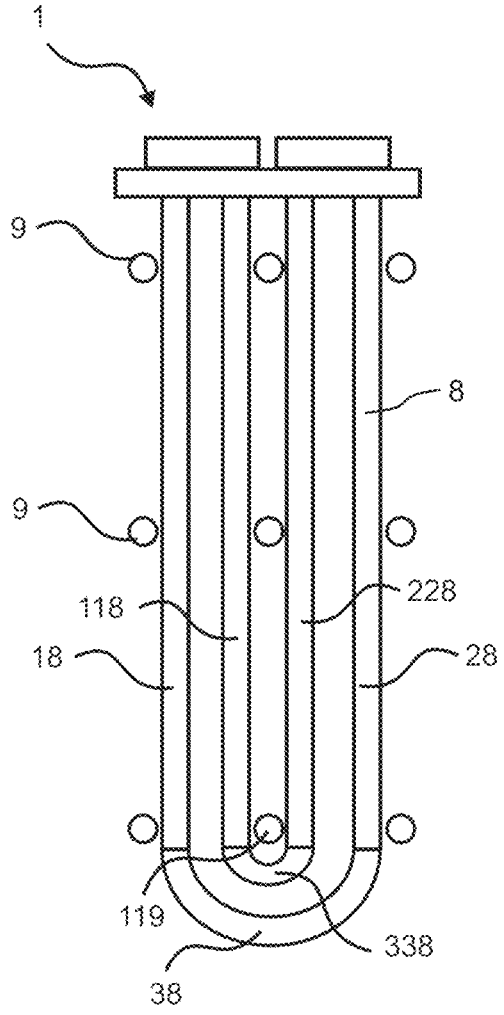
FIG. 3 is a schematic vertical cross section view of an embodiment of the cooling apparatus.
Figure 4:
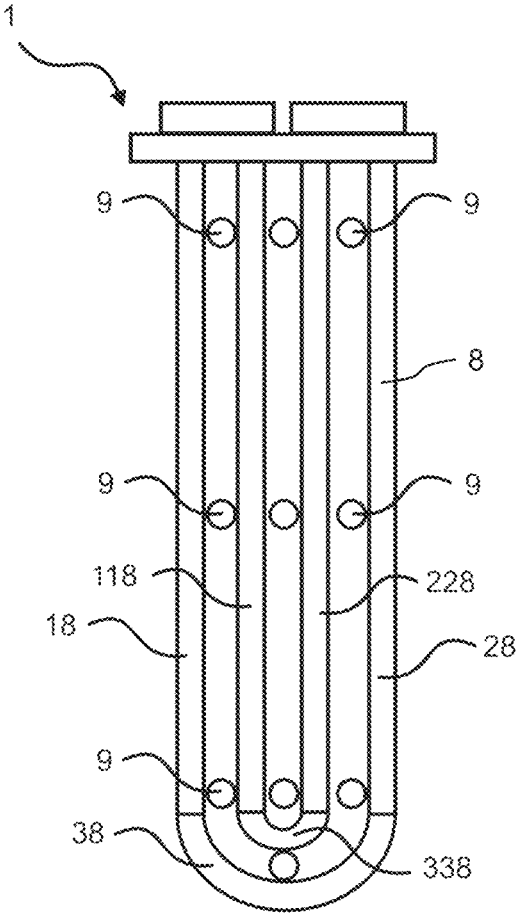
FIG. 4 is a schematic vertical cross section view of another embodiment of the cooling apparatus.

FIGS. 3 and 4 show alternative embodiments of the cooling apparatus 1 wherein at least one light source 9 is interposed between at least two tube portions 18, 28, 38, 118, 228, 338 so that the light from the light source 9 is casted towards both tube portions 18, 28, 38, 118, 228, 338. Further the light sources 9 are arranged in parallel to each other.

FIG. 3 shows the embodiment where light sources 9 are arranged to emit light towards the inner side of the tube bundle and at least one light source 9 is arranged to emit light towards the outer side of the tube bundle.

In an embodiment the cooling apparatus comprises a tube bundle comprising tube layers arranged in parallel along its width. Each tube layer comprises a plurality of hairpin type tubes 8 comprising two straight tube portions 18, 28 and one semicircular tube portion 38. The tubes 8 are disposed with their semicircular portions 38 concentrically arranged and their straight portions 18, 28 arranged in parallel, so that the innermost semicircular tube portions 38 are of relatively small radius and the outermost semicircular tube portions 38 are of relatively large radius, with the remaining intermediate semicircular tube portions 38 are of progressively graduated radius of curvature disposed therebetween.

In one variation of the above embodiment the tube bundle conforms with a rectangular prism shape with a half cylinder shape connected to the rectangular prism portion at the bottom end, as shown in FIG. 1.

In an embodiment the cooling apparatus 1 is further provided with at least one lamella 16 that is at least partly in contact with the tubes 8 so as to increase the heat transfer. In appropriate cases, especially cases in which a plurality of tubes 8 are present in a tube layer, it is preferred for the lamella 16 to be positioned so as to direct the light from the light source 9 towards the sides of the tube portions 18, 28, 38, 118, 228, 338 which otherwise remain in the shadow.

Figure 7:
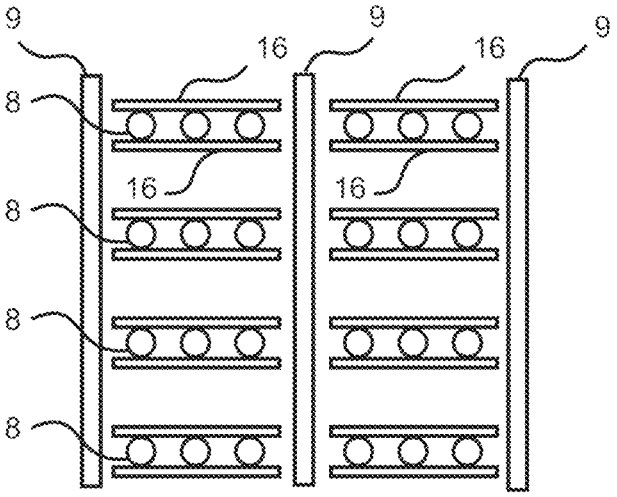
FIG. 7 is a schematic horizontal cross section view of an alternative embodiment of the cooling apparatus as described herein.

In a version of the above embodiment as shown in FIG. 7, the cooling apparatus 1 is provided with a plurality of vertical plate-shaped lamellas 16. Lamellas 16 are positioned such that multiple tubes 8 are arranged in between two lamellas 16 and the light source 9 is positioned on either side of the lamellas 16 in a direction perpendicular to both the tubes 8 and the lamellas 16.

Figure 2:
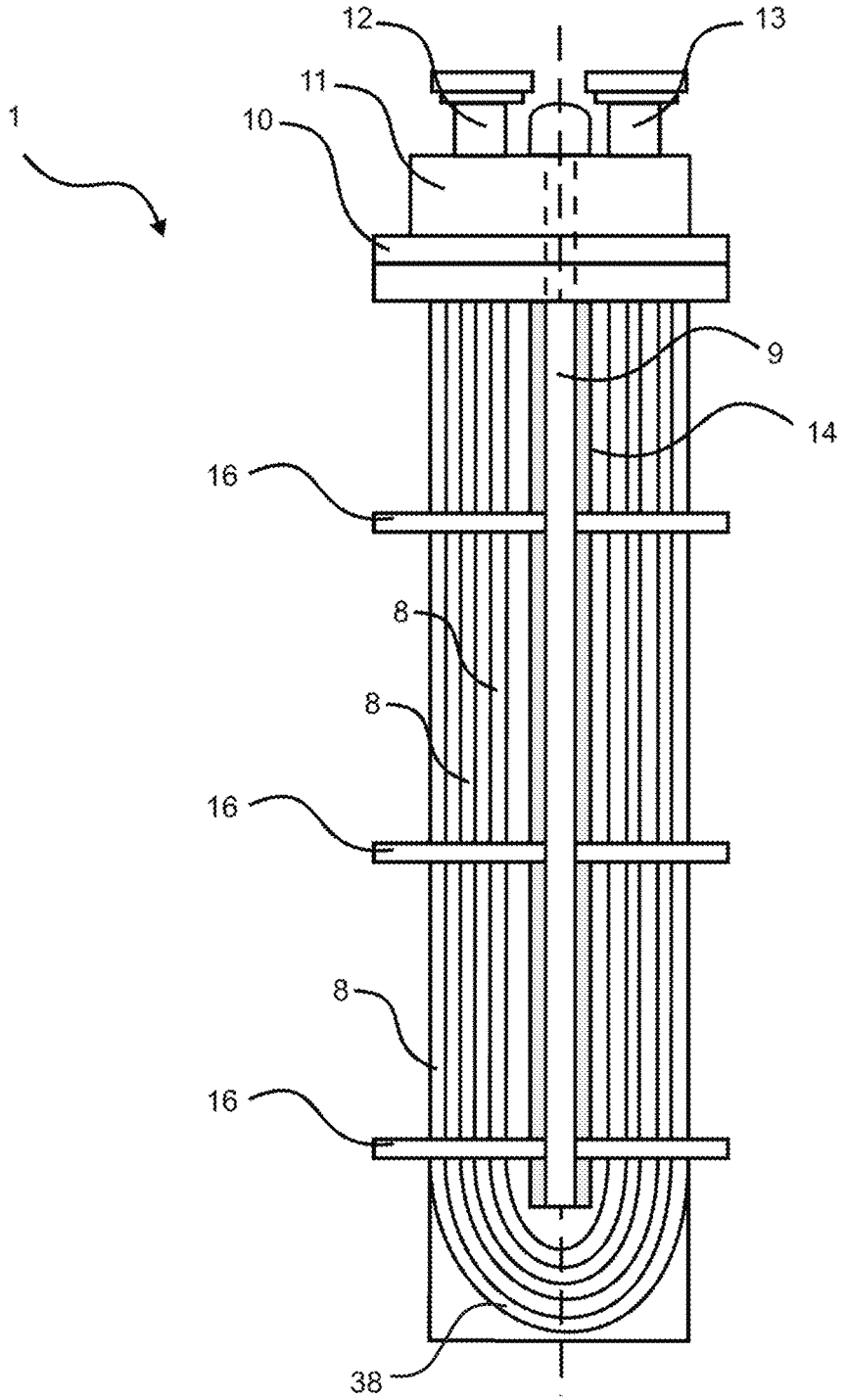
FIG. 2 is a schematic representation of another embodiment of the cooling apparatus.

In another variation of the above embodiment the tube bundle conforms with an elongated cylindrical shape with a hemispherical shape connected to the cylindrical portion 38 at the bottom end. Accordingly more tubes 8 are provided in the central layers and the layers above and below the central layers have a gradually decreasing number of tubes 8, as shown in FIG. 2. Accordingly, the outermost U-shaped tube portions 38 jointly define a generally hemispherical shape.

Figure 6:
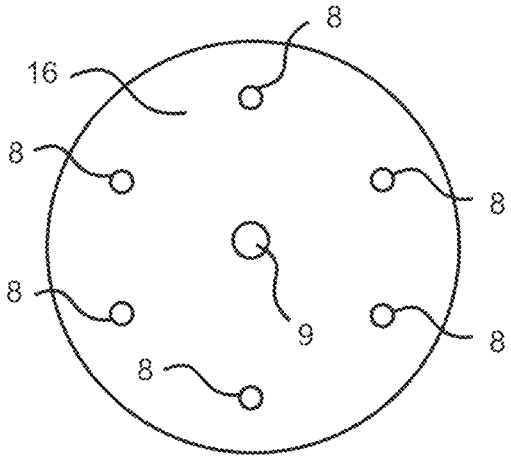
FIG. 6 is a schematic horizontal cross section view of the embodiment of the cooling apparatus as shown in FIG. 2.

In an embodiment the tube bundle is provided with a plurality of transverse plate-shaped lamellas 16 disposed in longitudinally spaced relation with each other and having the straight tube portions 18, 28, 118, 228 extending therethrough as shown in FIG. 2 and FIG. 6, thereby to maintain the tubes 8 in fixed spaced relationship with each other throughout their lengths. The lamellas 16 are provided with apertures for the straight tube portions 18, 28, 118, 228 to pass therethrough.

In an embodiment the cooling apparatus 1 as shown in FIG. 2 comprises a tube plate 10 on which the tubes 8 are mounted and a fluid header 11 connected to the tube plate 10 which comprises at least one inlet stub 12 and one outlet stub 13 for the entry and the exit of the fluid to and from the tubes 8 respectively. In this embodiment the cooling apparatus 1 further comprises a sleeve 14 within which the light source 9 is placed so as to protect the light source 9 from outside effects. One end of the sleeve 14 is attached to the fluid header 11 so as to provide ease of access for serviceability purposes. In particular, when installed in a final usage location the light source 9 will be accessible from the outside as well as the inlet stub 12 and the outlet stub 13, without a need for demounting the cooling apparatus 1 from the installed position.

Figure 8:
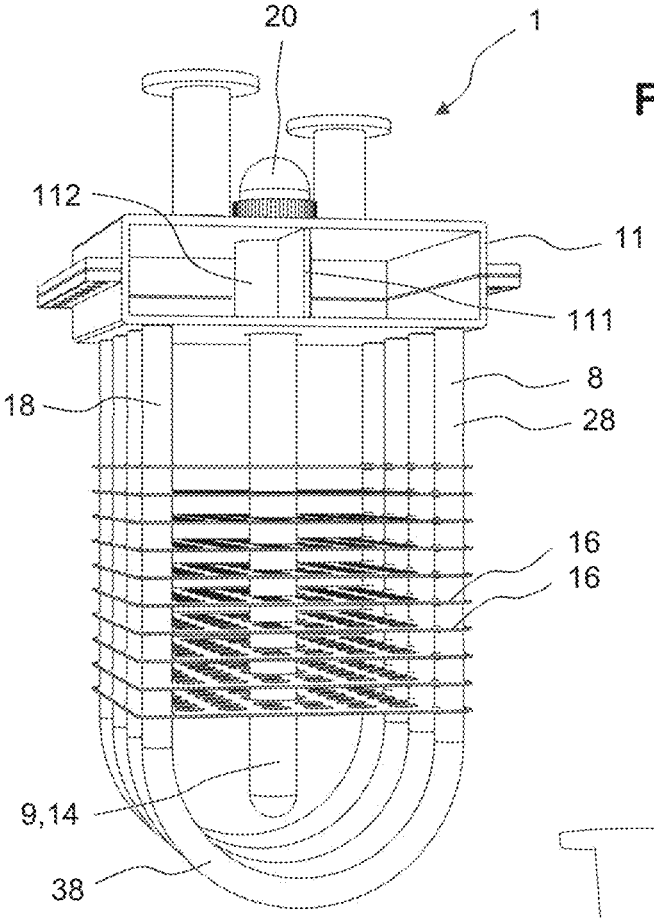
FIGS. 8 and 9 are schematic representations of yet another alternative embodiment of the cooling apparatus as described herein.
Figure 9:
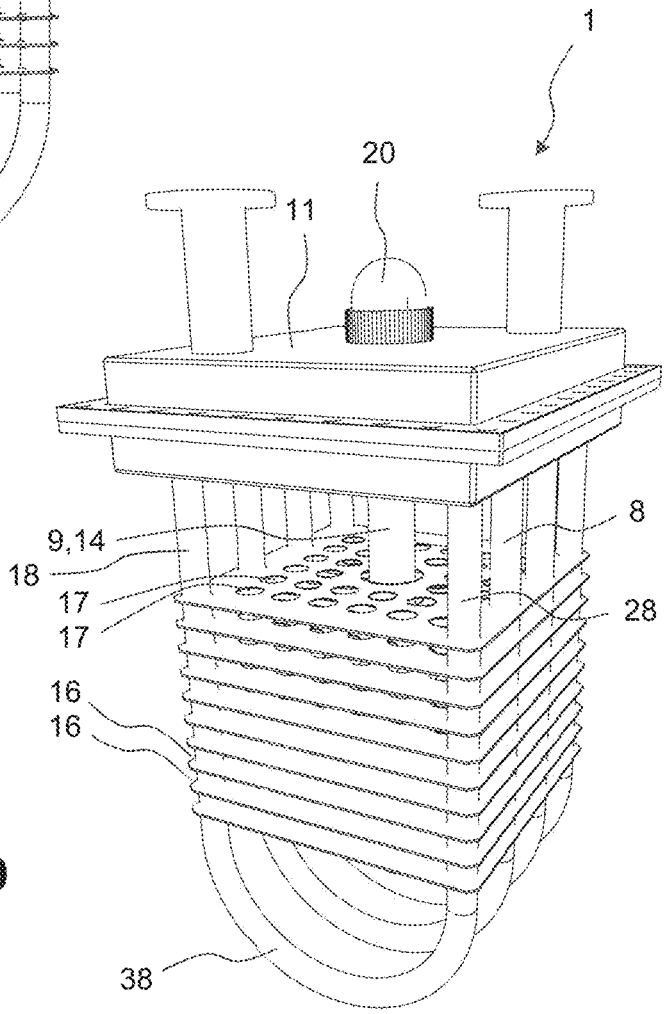

FIGS. 8 and 9 relate to an embodiment of the cooling apparatus 1 in which one centrally positioned light source 9 is used, extending in a vertical direction down from the fluid header 11, inside a protective sleeve 14. In this embodiment the cooling apparatus 1 is furthermore equipped with a plurality of transverse plate-shaped lamellas 16 disposed in longitudinally spaced relation with each other and having the straight tube portions 18, 28 extending therethrough. The lamellas 16 have various functions. In the first place the lamellas 16 serve to maintain the tubes 8 in fixed spaced relationship with each other throughout their lengths. To that end the lamellas 16 are provided with apertures for the straight tube portions 18, 28 to pass therethrough. In the second place the lamellas 16 serve for enhancing heat transfer from the tubes 8 to the sea water. To that end the lamellas 16 are at least partly in contact with the tubes 8. Preferably both the tubes 8 and the lamellas 16 comprise material having excellent thermal conductivity. In the third place the lamellas 16 are positioned so as to direct the light from the light source 9 towards the tube portions 18, 28, which is especially the case when the lamellas 16 are at least partially coated with an antifouling light reflective coating. The tubes 8 may be at least partially coated with such a coating as well.

In comparison with the transverse lamellas 16 as shown in FIG. 2, adjacent transverse lamellas 16 of the cooling apparatus 1 as shown in FIGS. 8 and 9 are arranged at a relatively short distance with respect to each other. In order for the flow of sea water through the cooling apparatus 1 not to be hindered too much, the lamellas 16 are not only provided with apertures for allowing the tubes 8 and the sleeve 14 containing the light source 9 to pass therethrough, but also with apertures 17 for allowing the sea water to pass therethrough.

In the configuration of the cooling apparatus 1 as shown in FIGS. 8 and 9, the tubes 8, the light source 9 and the lamellas 16 are positioned relative to each other in such a way as to have minimal shadow effects in the cooling apparatus 1, which means that light from the light source 9 is capable of reaching almost every surface. The light may hit the lamellas 16 under a sharp angle, but it is still ensured that some of the light reaches the outer corners of the lamellas 16, i.e. the area of the lamellas 16 near the tubes 8. Hence, the lamellas 16 are also kept free from bio-fouling under the influence of the light source 9.

The assembly of the light source 9 and the protective sleeve 14 extends through the fluid header 11. In the shown example the protective sleeve 14 has a circular periphery. A portion of the protective sleeve 14 as present in the fluid header 11 may be incorporated in an internal construction 111 of the fluid header 11 which serves for separating the relatively hot fluid to be supplied to the tubes 8 from the relatively cool fluid discharged from the tubes 8. In particular, such a construction 111 may have a cylinder-shaped portion 112 for constituting the portion of the protective sleeve 14, as can be seen in FIG. 8 in which the fluid header 11 is shown with an open side for the sake of illustration. When it is necessary to remove the light source 9 from the cooling apparatus 1, it is possible to do so by removing a central cap 20 from the fluid header 11 and then pulling out the light source 9 in an upward vertical direction, wherein there is no need for taking the cooling apparatus 1 further apart, which is an important advantage of the arrangement of the sleeve 14 for accommodating the light source 9 according to which the sleeve 14 is vertically oriented while extending both through the fluid header 11 and between the various tubes 8. Also, putting the light source 9 back in place after having been removed is a process which can easily be performed. Within the framework of the invention, it is also possible for the sleeve 14 to be removably arranged in the cooling apparatus 1. In such a case, it is advantageous if the cylinder-shaped portion 112 of the internal construction 111 of the fluid header 11 is arranged so as to encompass the portion of the sleeve 14 as present inside the fluid header 11.

It is noted that the lamellas 16 may have apertures for allowing the tubes 8 to pass therethrough, as mentioned in the foregoing, but as an alternative, it is possible for the lamellas 16 to be formed as an integral whole with sections of the straight tube portions 18, 28 extending through the lamellas 16, which whole will hereinafter be referred to as lamella element. In that case, during assembly of the cooling apparatus 1, the tubes 8 are realized by connecting a number of lamella elements to a portion of the tubes 8 extending down from the fluid header 11, wherein a first lamella element is attached to the portion of the tubes 8 as mentioned, a second lamella element is attached to the first lamella element, a third lamella element is attached to the second lamella element, etc. A U-shaped portion 38 of the tubes 8 is attached to the last lamella element of the thus obtained stack of lamella elements in order to complete the tubes 8. Hence, when lamella elements as mentioned are applied, a segmented appearance of the tubes 8 is obtained. The application of the lamella elements may contribute to facilitation of the manufacturing process of the cooling apparatus 1.

Figure 10:
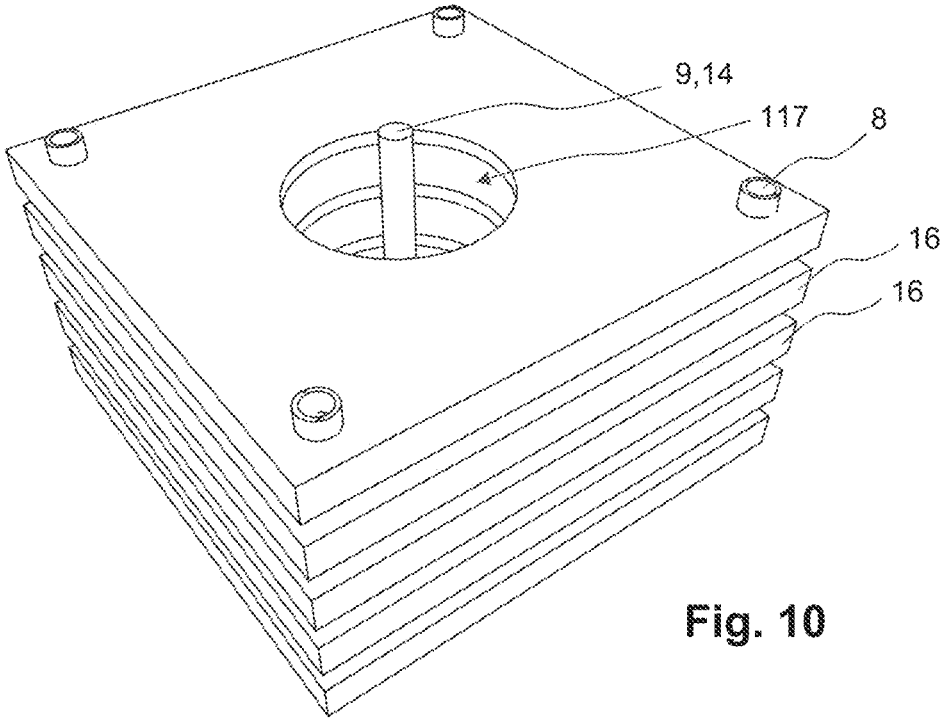
FIGS. 10 and 11 are schematic representations of a portion of a further embodiment of the cooling apparatus as described herein.
Figure 11:
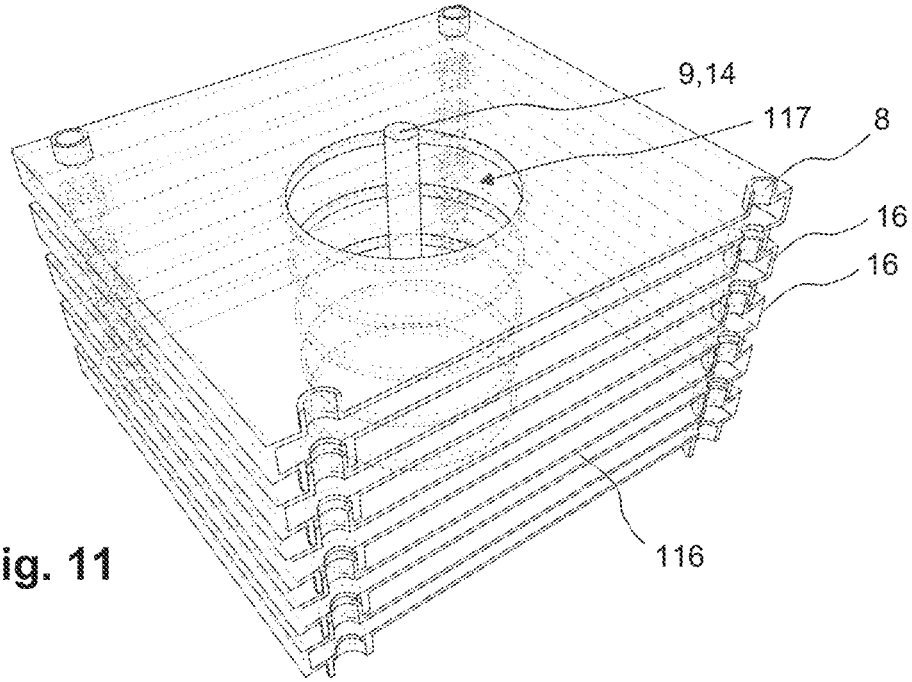
Figure 12:
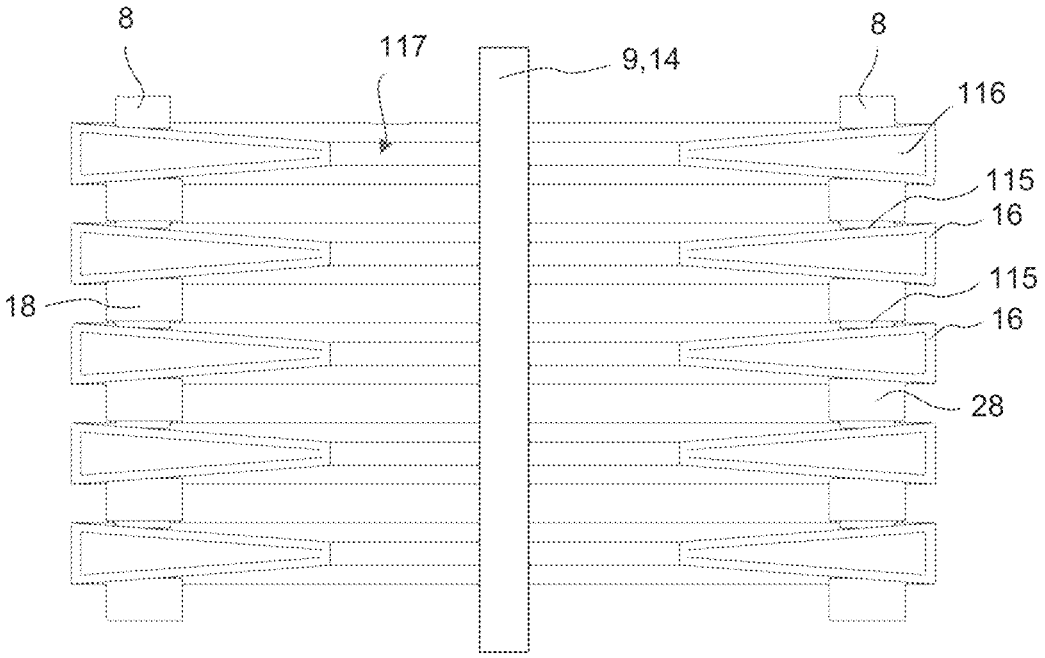
FIG. 12 is a schematic vertical cross section view of the portion of the embodiment of the cooling apparatus as shown in FIGS. 10 and 11.

FIGS. 10, 11 and 12 serve to illustrate the fact that as an alternative, hollow lamellas 16 may be used in the cooling apparatus 1. In that case, the interior space 116 of the hollow lamellas 16 is in direct communication with the tubes 8. Thus, during operation of the cooling apparatus 1, the fluid to be cooled is not only transported through the tubes 8, but also through the lamellas 16. In that way, very effective transfer of heat to the sea water is obtained, which allows for a design of the cooling apparatus 1 with a decreased number of tubes 8, for example, which may be beneficial to the anti-fouling effect of the light source 9 due to the fact that less obstacles are present in the path followed by the light that shines from the light source 9 during operation thereof. For the sake of completeness, it is noted that the hollow lamellas 16 are provided with a central aperture 117 for allowing the assembly of the light source 9 and the sleeve 14 to pass therethrough.

FIG. 10 shows a perspective view of a number of hollow lamellas 16, portions of tubes 8 as present in the area of the cooling apparatus 1 where the lamellas 16 are located, and a portion of the assembly of the light source 9 and the sleeve 14. FIG. 11 shows a similar view, with a section at one side for illustrating the fact that the interior space 116 of the lamellas 16 is open to the tubes 8. Also, structural lines which are hidden from sight in the representation of FIG. 10 are indicated by means of dotted lines in the representation of FIG. 11. FIG. 12 shows a sectional view of the lamellas 16, and furthermore shows the portions of tubes 8 and the portion of the assembly of the light source 9 and the sleeve 14 as shown in FIGS. 10 and 11. It is practical for the hollow lamellas 16 to be formed as an integral whole with sections of the straight tube portions 18, 28 extending through the lamellas 16 so that a portion of the cooling apparatus 1 having the lamellas 16 can be assembled by stacking lamella elements 115 comprising a combination of a lamella 16 and sections of the straight tube portions 18, 28 and interconnecting those lamella elements 115.

Figure 5:
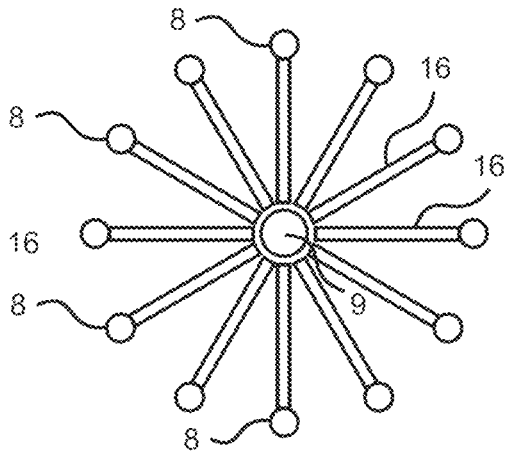
FIG. 5 is a schematic horizontal cross section view of yet another embodiment of the cooling apparatus.

FIG. 5 shows another embodiment of the cooling apparatus 1. In this embodiment the cooling apparatus 1 comprises longitudinal lamellas 16 extending in between two tube portions 18, 28, 118, 228 or between a tube portion 18, 28, 118, 228 and a light source 9 so as to enhance the heat transfer and/or the antifouling effect of the light source 9.

In a preferred version of this embodiment the light source 9 is positioned at the center, the tubes 8 are positioned in a cylindrical configuration around the light source 9 and the lamellas 16 are extending from each tube portion 18, 28, 118, 228 towards the central light source 9 as shown in FIG. 5.

Elements and aspects discussed for or in relation with a particular embodiment may be suitably combined with elements and aspects of other embodiments, unless explicitly stated otherwise. The invention has been described with reference to the preferred embodiments. Modifications and alterations may occur to others upon reading and understanding the preceding detailed description. It is intended that the invention be construed as including all such modifications and alterations insofar as they come within the scope of the appended claims or the equivalents thereof. As fouling may also happen in rivers or lakes or any other area where the cooling apparatus is in contact with water, the invention is generally applicable to cooling by means of water.

The invention claimed is:

1. A cooling apparatus for cooling a fluid, the cooling apparatus comprising:

at least one tube for containing and transporting the fluid, an exterior of the at least one tube being in operation at least partially submerged in surface water flowing through a cooling box through an entry opening via natural flow, so as to cool the fluid in the at least one tube; and at least one light source for producing anti-fouling light, wherein the at least one light source is dimensioned and positioned in the cooling box with respect to the at least one tube so as to cast the anti-fouling light over the exterior of the at least one tube.

2. The cooling apparatus according to claim 1, wherein the at least one tube comprises at least two tube portions, and wherein the at least one light source is interposed between the at least two tube portions so that the anti-fouling light from the at least one light source is casted towards both of the at least two tube portions.

3. The cooling apparatus according to claim 1, wherein the at least one light source is a tubular lamp.

4. The cooling apparatus according to claim 1, wherein the at least one light source is arranged substantially perpendicular to an orientation of the at least one tube.

5. The cooling apparatus according to claim 1, wherein the at least one light source comprises a plurality of light sources arranged substantially in parallel to each other.

6. The cooling apparatus according to claim 1, wherein the at least one light source extends along a full width of the cooling apparatus.

7. The cooling apparatus according to claim 1, wherein the at least one tube comprises a plurality of tubes in a tube bundle, and wherein the at least one light source comprises at least one first light source arranged to emit the anti-fouling light towards an inner side of the tube bundle and at least one second light source arranged to emit anti-fouling light towards an outer side of the tube bundle.

8. The cooling apparatus according to claim 7, wherein the plurality of tubes are U-shaped, such that each tube has a semicircular tube portion, and wherein the at least one first light source is arranged at an inner side center of the semicircular tube portion.

9. The cooling apparatus according to claim 1, wherein the at least one tube comprises a plurality of tubes in a tube bundle conforming with a rectangular prism shape with a half cylinder shape connected to the rectangular prism shape at a bottom end, and wherein the at least one light source is arranged to lie on or in parallel to an axis line of the half cylinder shape.

10. The cooling apparatus according to claim 1, wherein the at least one tube comprises a plurality of tubes in a tube bundle conforming to an elongated cylindrical shape with a hemispherical shape connected to the elongated cylindrical shape at a bottom end, and wherein the at least one light source is arranged to lie on or in parallel to an axis line of the elongated cylindrical shape.

11. The cooling apparatus according to claim 1, further comprising at least one lamella that is at least partly in contact with the at least one tube, wherein the at least one lamella is hollow, an interior space of the at least one lamella being in direct communication with the at least one tube.

12. The cooling apparatus according to claim 11, wherein the at least one light source and the at least one lamella are positioned relative to each other to have light from the at least one light source hit the at least one lamella under a sharp angle.

13. The cooling apparatus according to claim 12, wherein the at least one lamella comprises a plurality of transverse lamellas disposed in longitudinally spaced relation with each other and having straight tube portions of the at least one tube extending therethrough.

14. The cooling apparatus according to claim 13, wherein the plurality of transverse lamellas are shaped like plates.

15. The cooling apparatus according to claim 14, further comprising a sleeve to protect the at least one light source from outside effects.

16. The cooling apparatus according to claim 15, wherein the sleeve is centrally positioned.

17. The cooling apparatus according to claim 16, comprising a tube plate on which the at least one tube is mounted, and connected to the tube plate a fluid header comprising one inlet stub and one outlet stub for entry and exit of the fluid to and from the at least one tube, respectively.

18. A ship comprising the cooling apparatus according to claim 1 for cooling of machinery of the ship, wherein the surface water comprises sea water.

19. The ship according to claim 18, wherein the cooling box is defined by a hull of the ship and partition plates, such that the entry opening and an exit opening are provided on the hull so that the sea water enters the entry opening, flows through the cooling box, and exits the exit opening, and wherein inner surfaces of the cooling box are at least partially coated with an anti-fouling light reflective coating.

20. The ship according to claim 18, wherein the cooling box is defined by a hull of the ship and partition plates, such that an entry opening and an exit opening are provided on the hull so that the sea water enters the entry opening, flows through the cooling box, and exits the exit opening, and wherein the at least one light source is part of or attached to an inner surface of the cooling box.

* * * * *